US009844276B1

(12) United States Patent
Phillips

(10) Patent No.: US 9,844,276 B1
(45) Date of Patent: Dec. 19, 2017

(54) SPIDER BED

(71) Applicant: Alicia D. Phillips, Rockledge, FL (US)

(72) Inventor: Alicia D. Phillips, Rockledge, FL (US)

( * ) Notice: Subject to any disclaimer, the term of this patent is extended or adjusted under 35 U.S.C. 154(b) by 0 days.

(21) Appl. No.: 15/597,685

(22) Filed: May 17, 2017

Related U.S. Application Data

(60) Provisional application No. 62/475,533, filed on Mar. 23, 2017.

(51) Int. Cl.
*A47C 21/02* (2006.01)

(52) U.S. Cl.
CPC ..... *A47C 21/022* (2013.01)

(58) Field of Classification Search
CPC ..... A47C 21/022
USPC ..... 5/494, 490, 498–499, 504.1
See application file for complete search history.

(56) References Cited

U.S. PATENT DOCUMENTS 4,422,195 A 12/1983 Russo et al.
4,461,049 A 7/1984 Hammond
5,072,470 A * 12/1991 Lysiak ..... A47C 21/022 5/496
5,179,743 A * 1/1993 Lanman ..... A47C 21/022 24/465
D387,602 S * 12/1997 Cerdan ..... D6/607

OTHER PUBLICATIONS

Sheet Buddy, An extra pair of hands to make up your bed, retrieved from http://sheetbuddy.com/about.html retrieved on May 8, 2017, 3 pages.

* cited by examiner

*Primary Examiner* — Fredrick C Conley
(74) *Attorney, Agent, or Firm* — Brian S. Steinberger; Law Offices of Brian S. Steinberger, P.A.

(57) ABSTRACT

Devices, apparatus, systems and methods for keeping bottom sheets kept in place about mattresses with a cross pattern of elastic bands placed under a mattress having ends with clips. The clips can clamp to outer edges of the bottom sheet, with the elastic bands also able to additionally keep bottom edges of top sheets and/or bottom edges of blankets in place. The clip ends can be selected from at least one of alligator clips, suspender clips, clamps, and the like.

12 Claims, 8 Drawing Sheets

SPIDER BED

This application claims the benefit of priority to U.S. Provisional Patent Application Ser. No. 62/475,533 filed Mar. 23, 2017, which is incorporated by reference in its' entirety.

FIELD OF INVENTION

This invention relates to bedding, and in particular to devices, apparatus, systems and methods for keeping bottom sheets kept in place about mattresses with a cross pattern of elastic bands placed under a mattress with clip ends which clamp to outer edges of the bottom sheet, with the elastic bands able to additionally keep bottom edges of top sheets and/or bottom edges of blankets in place.

BACKGROUND AND PRIOR ART

Fitted sheets have become increasingly popular over the years to help hold the bottom sheets on a mattress from easily being loosened. Popular types of fitted sheets having included sheets having sewn elastic bands forming pockets and/or sewn corner pockets. See for example, U.S. Pat. No. 4,222,195 to Russo et al. and U.S. Pat. No. 4,461,049 to Hammond.

However, even with corner pockets, the bottom sheets will still tend to disengage from the mattress corners and ultimately ride up on the bed itself after the sleeping persons moves on the bed. After the pocket corners become disengaged, the slipping sheet corners will tend to slip and run up on the surface of the bed and crunch up under the bed occupant causing discomfort for the persons attempting to sleep on the mattress.

Thus, the need exists for solutions to the above problems with the prior art.

SUMMARY OF THE INVENTION

A primary objective of the present invention is to provide devices, apparatus, systems and methods to keep bottom sheets kept in place on mattresses with a cross pattern of elastic bands placed under a mattress with clip ends which clamp to outer edges of the bottom sheet.

A secondary objective of the present invention is to provide devices, apparatus, systems and methods to keep bottom sheets kept in place about mattresses with a cross pattern of elastic bands placed under a mattress with clip ends which clamp to outer edges of a bottom sheet and a top sheet.

A third objective of the present invention is to provide devices, apparatus, systems and methods to keep bottom sheets kept in place about mattresses with a cross pattern of elastic bands placed under a mattress with clip ends which clamp to outer edges of a bottom sheet and a top sheet and a blanket.

A fourth objective of the present invention is to provide devices, apparatus, systems and methods to keep bottom sheets kept in place about mattresses with a cross pattern of elastic bands placed under a mattress with clip ends which clamp to outer edges of a bottom sheet and a blanket.

A preferred embodiment can include an eight-legged elastic gripper that secures eight points on the edges of a bottom sheet and/or top sheet and/or blanket that is located over a mattress, on all sizes of beds.

A cross pattern of up to approximately 2 inch wide by up to approximately a few feet or more in length, elastic bands, with ends of the bands having clips thereon. The cross pattern of bands can be slipped under a mattress and generally centered on a box spring. When the clip ends are attached to all four corner edges of a bottom sheet, and to outer edge portions of the bottom sheet between the corners, the cross pattern of elastic bands centers itself easily.

The novel invention provides for worry free nights of comfort without the bottom sheets being disengaged from the mattress and becoming crunched up underneath the sleeping persons.

Additionally, the invention provides for worry free nights of comfort without the top sheets any blanket or other covering from being disengaged from the mattress.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 Four straps with eight clip sheet securing device with stitched union point.
20 Closed sheet clip.
25 Open sheet clip.
30 Elastic straps/bands.
40 Lower jaw of sheet clip.
50 Upper jaw of sheet clip.
60 Toggle lock lever of sheet clip.
70 Strap ring of sheet clip.
80 Elastic strap attachment to clip.
90 Stitched strap union point.
100 Stitching/stitched.
110 Mattress.
120 Bottom sheet, such as fitted or unfitted sheet.
130 Twelve clip sheet securing device with stitched union point.
140 Eight clip sheet securing device with central metal or plastic ring union point.
145 Central metal ring union point.
150 Central metal ring.
160 Elastic strap wraps around ring to secure strap to ring.
170 Elastic strap attachment to ring.

Figure 1:
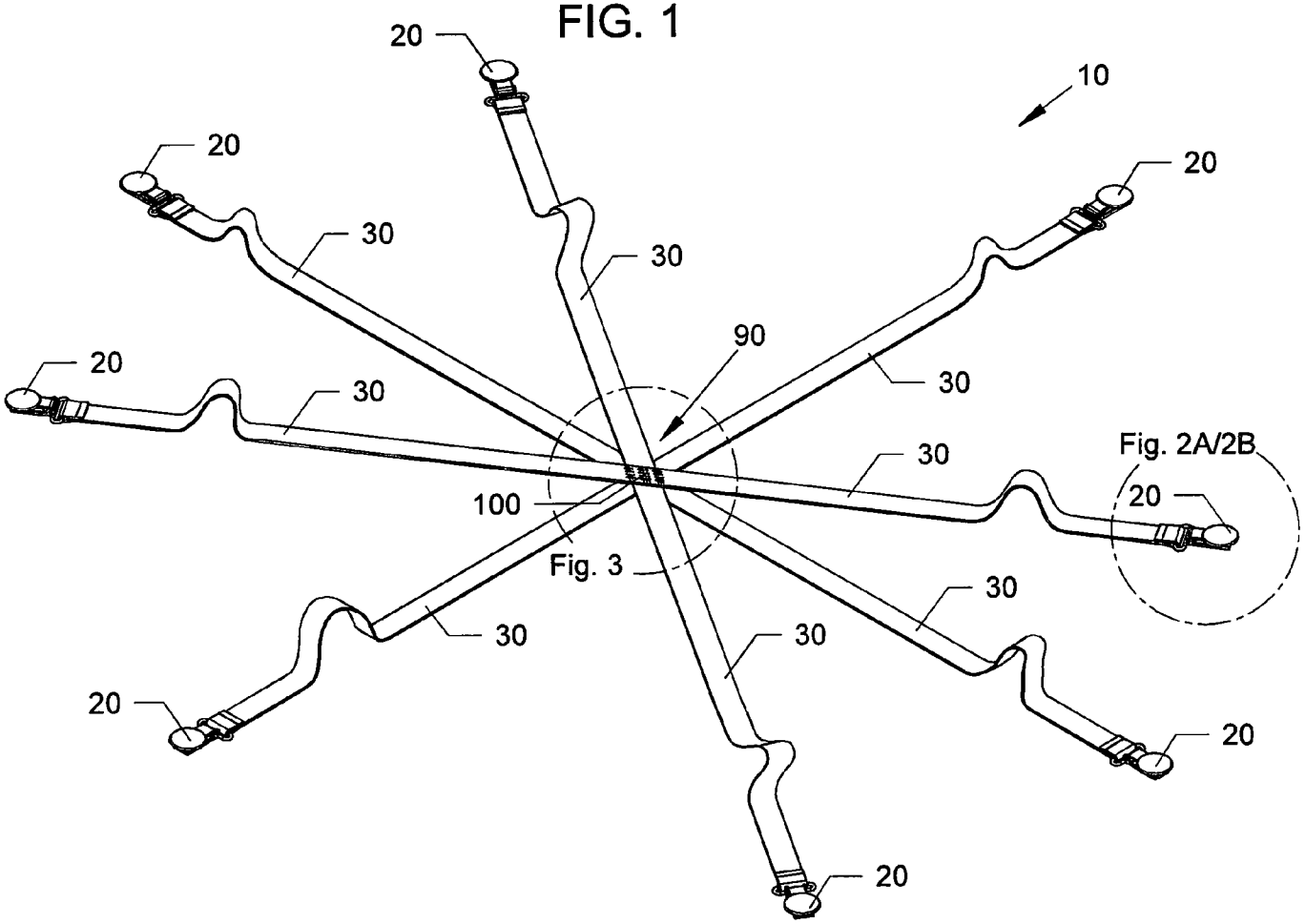
FIG. 1 is a perspective view of four straps with eight clip ends sheet securing device standing alone.

FIG. 1 is a perspective view of four straps with eight clip ends sheet securing device 10 standing alone.

Figure 2A:
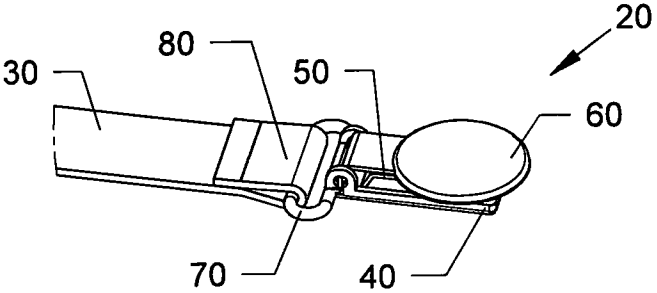
FIG. 2A is an enlarged view of a clip of FIG. 1 in a closed position.
Figure 2B:
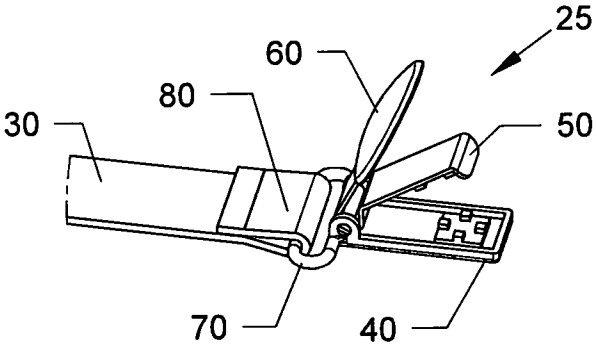
FIG. 2B is another view of the clip of FIG. 2A in an open position.

FIG. 2A is an enlarged view of a clip 20 of FIG. 1 in a closed position. FIG. 2B is another view of the clip 25 of FIG. 2A in an open position.

Figure 3:
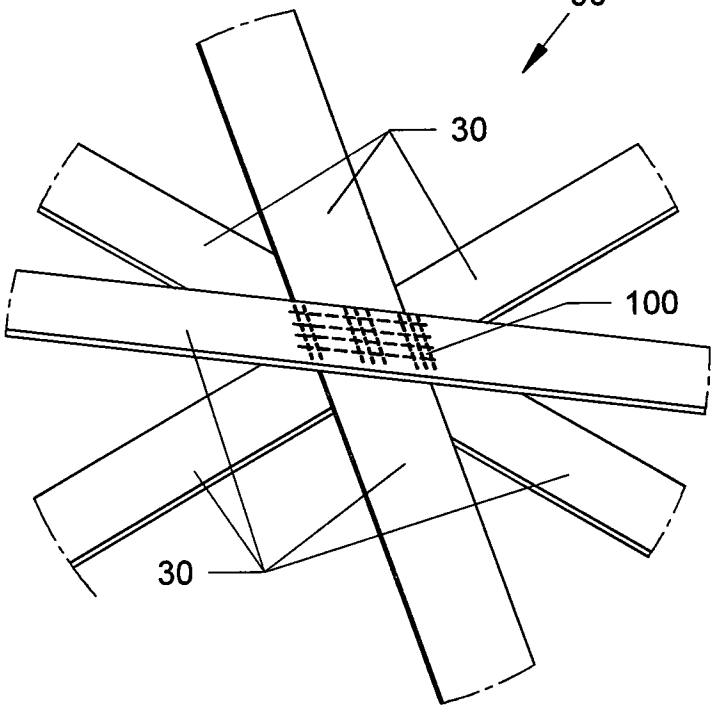
FIG. 3 is an enlarged view of the stitched cross portion of the four straps used in the securing device of FIG. 1.

FIG. 3 is an enlarged view of the stitched cross portion 90 of the four straps 30 used in the securing device 10 of FIG. 1.

Figure 4:
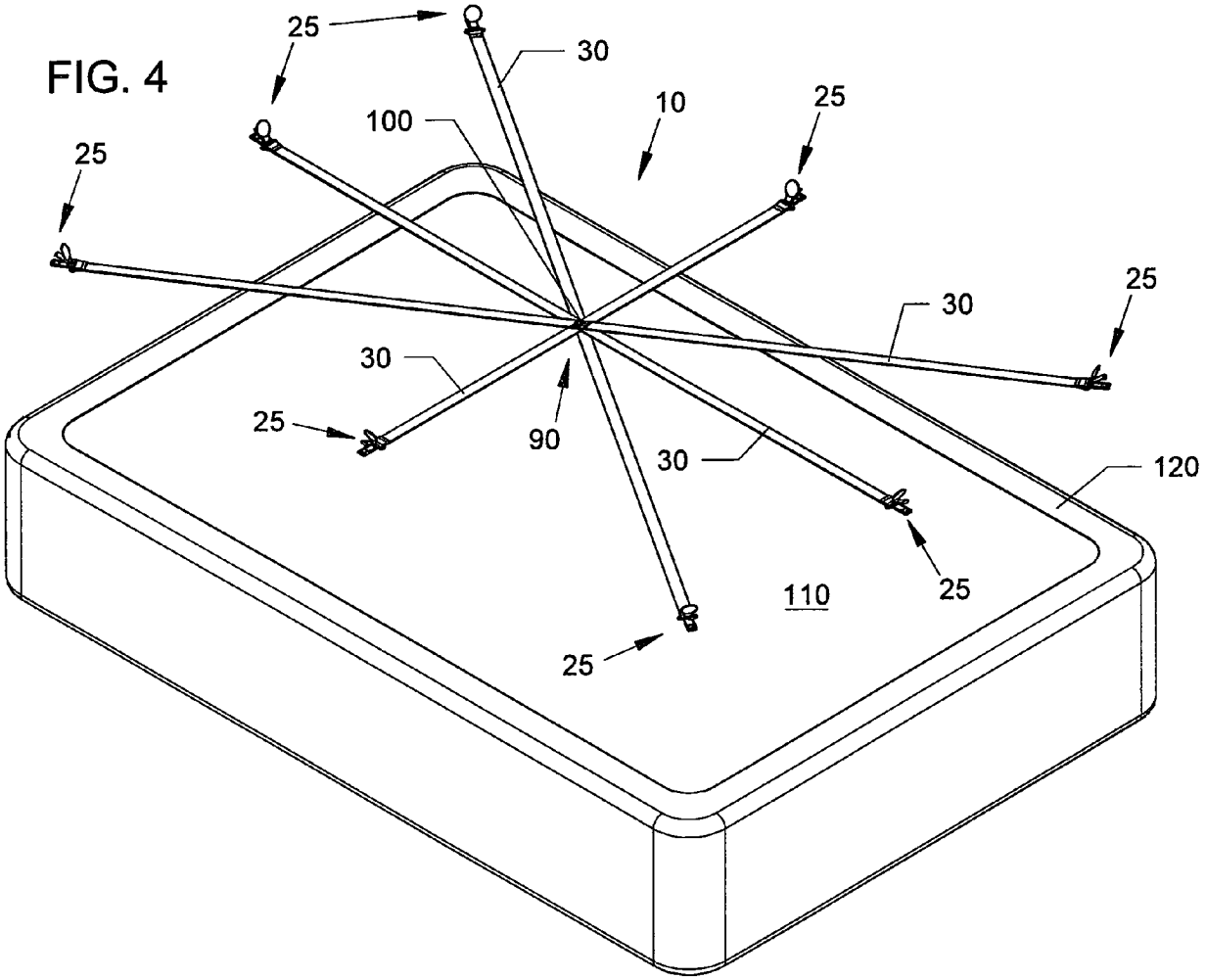
FIG. 4 is a perspective view of the securing device of FIG. 1 being positioned to install under a mattress having a bottom sheet thereon.
Figure 5:
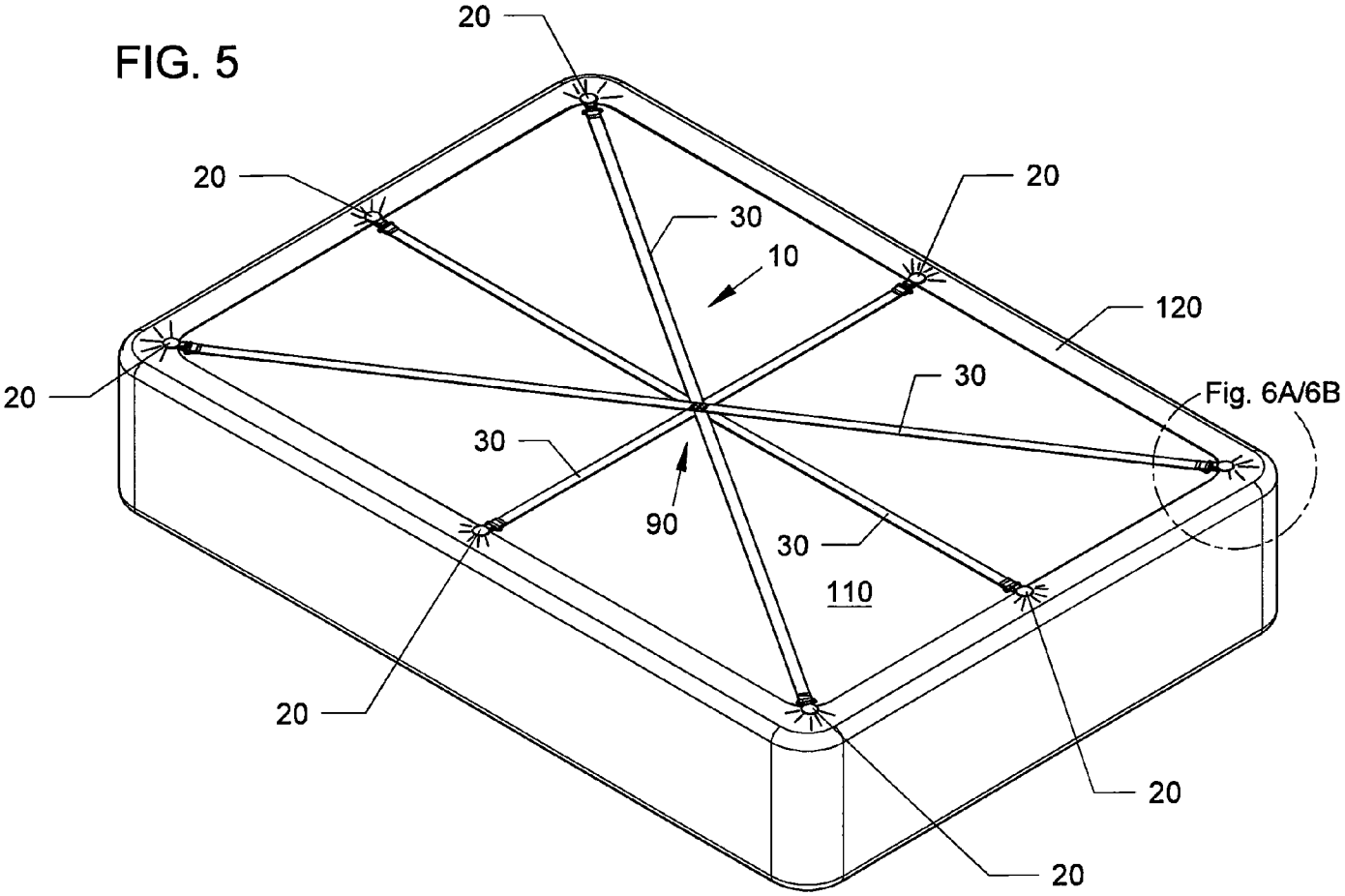
FIG. 5 is a perspective view of FIG. 4 with the sheet securing device and clips installed to the bottom sheet.

FIG. 4 is a perspective view of the securing device 10 of FIG. 1 being positioned to install under a mattress having a bottom sheet 120 thereon. FIG. 5 is a perspective view of FIG. 4 with the sheet securing device 10 and clips 20 installed to the bottom sheet 120.

Figure 6B:
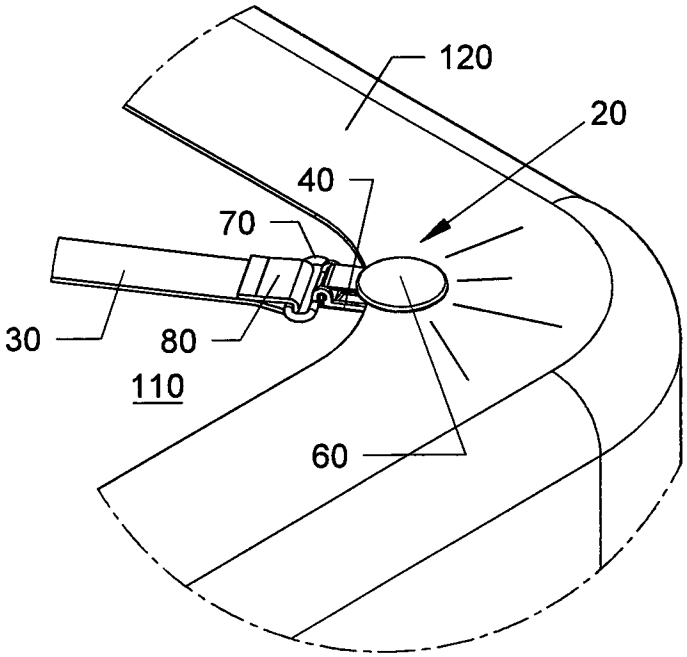
FIG. 6B is another view of the clip of FIG. 6A installed onto the sheet.
Figure 6A:
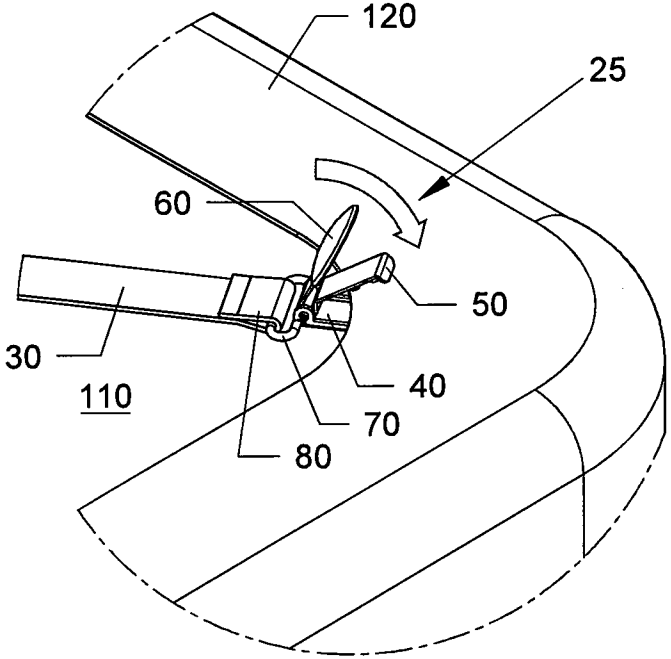
FIG. 6A is an enlarged view of a clip shown in FIG. 5 in an open position ready to be installed onto the sheet.

FIG. 6A is an enlarged view of a clip 25 shown in FIG. 5 in an open position ready to be installed onto the sheet 120. FIG. 6B is another view of the clip 20 of FIG. 6A installed onto the sheet 120.

Referring to FIGS. 1-6B, the device 10 can have a spider configuration with a central cross pattern of elastic bands/straps 30 that can be positioned on a box spring underneath a mattress 110 having a bottom sheet 120 attached thereon.

An embodiment of the cross pattern of elastic bands/straps 30 can include eight elastic bands/straps 30 having a central cross union point 90 where the bands/straps 30 cross and are stitched together 100. The free ends of the bands/straps can include clips 20/25.

The four bands/straps 30 can each a width of up to approximately 2 inches or more. Each of the elastic bands/straps 30 can have a length of up to approximately 3½ feet up to approximately 4 and ½ feet, and longer.

The elastic bands/straps 30 can be formed from a fabric that includes stretchable elastic material therein which allows the bands to stretch, and retain a memory to pull back to their original length.

Each of the eight elastic bands/straps 30 can have free ends clips 20/25 that can attach to all four corner portions of the outer edges of the bottom sheet on the bed, with four additional clips bands/straps 30 that can attach to outer edge portions of the bottom sheet between each of the four corner portions of the bottom sheet 120.

To assemble the device 10, a bottom sheet 120 can be attached about an upper surface of a mattress 110. The bottom sheet 120 can be a fitted sheet, or a non-fitted sheet.

Next, the device 10 can be positioned underneath the mattress 110 and be pushed into place by one's arms, or a longitudinal member, such as a yardstick, pole, and the like.

Each of the open clips 25 can be a clamp type clip having a lower jaw 40, upper jaw 50 and toggle type lock lever 60, that each pivotally attached to one another, with a strap ring 70, with the end of the bands/strap 34 folded 80 and mounted to the ring 70. Next the open clips 25 on the free ends of the bands/straps 30 can be positioned about and locked into place as a clip 20 onto various spaced apart edges of the bottom sheet 120.

Alternatively, the mattress 110 with attached bottom sheet 120 can be turned upside down, followed by positioning the device in place and attaching each of the clips 20/25 to edges of the sheet 120, followed by flipping the mattress back.

The cross pattern device 10 of elastic bands/straps 30 can be sized to fit under a single mattress, a double mattress, a queen mattress and/or a king size mattress.

Although the separate central cross portion 90 of the bands/straps 30 is shown stitched 100 together, the central portion can include a separate material, such as but not limited to a hexagon material that can be made of material, such as but not limited to fabric, cloth, leather, vinyl, combinations, thereof, and the like. This separate material can also be stitched in place.

The central portion can be sewn to the cross axis formed from the cross pattern on elastic bands.

Figure 7:
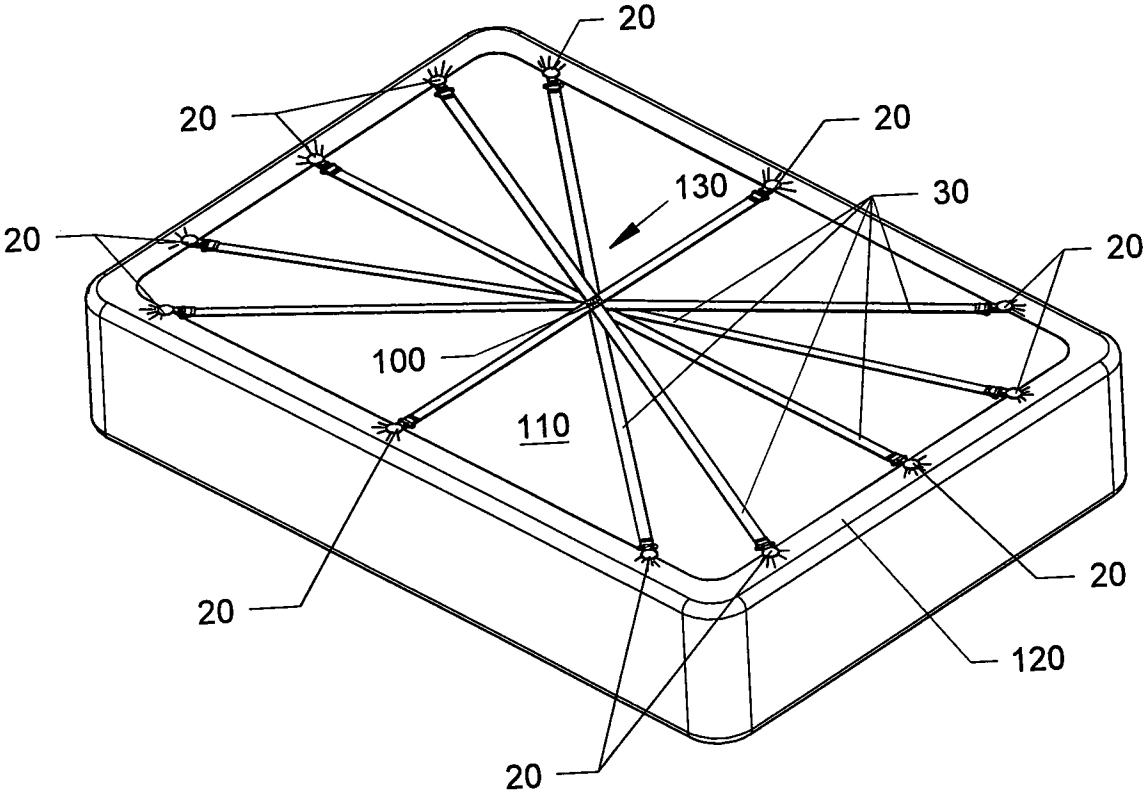
FIG. 7 is a perspective view of an alternative sheet securing device with twelve clips installed to a sheet.

FIG. 7 is a perspective view of an alternative sheet securing device 30 having twelve bands/straps 30 with twelve clips 20 installed to a sheet 120. This larger number of clips 20 can be used on larger mattresses and/or can be used to have more contact points with edges of the bottom sheet 120 on the mattress 110.

Figure 8:
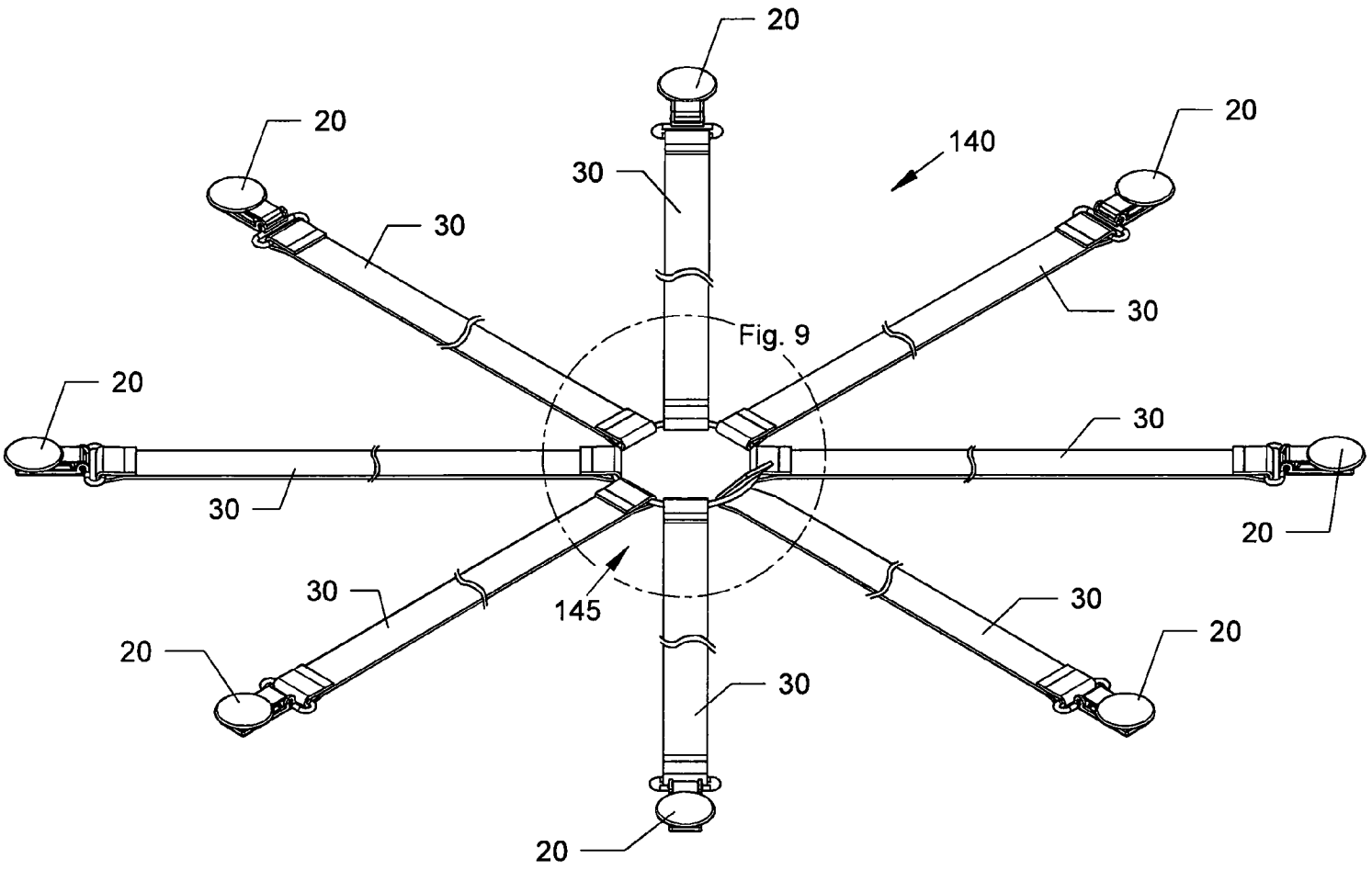
FIG. 8 is a perspective view of an eight clip sheet securing device with an alternate ring union point.
Figure 9:
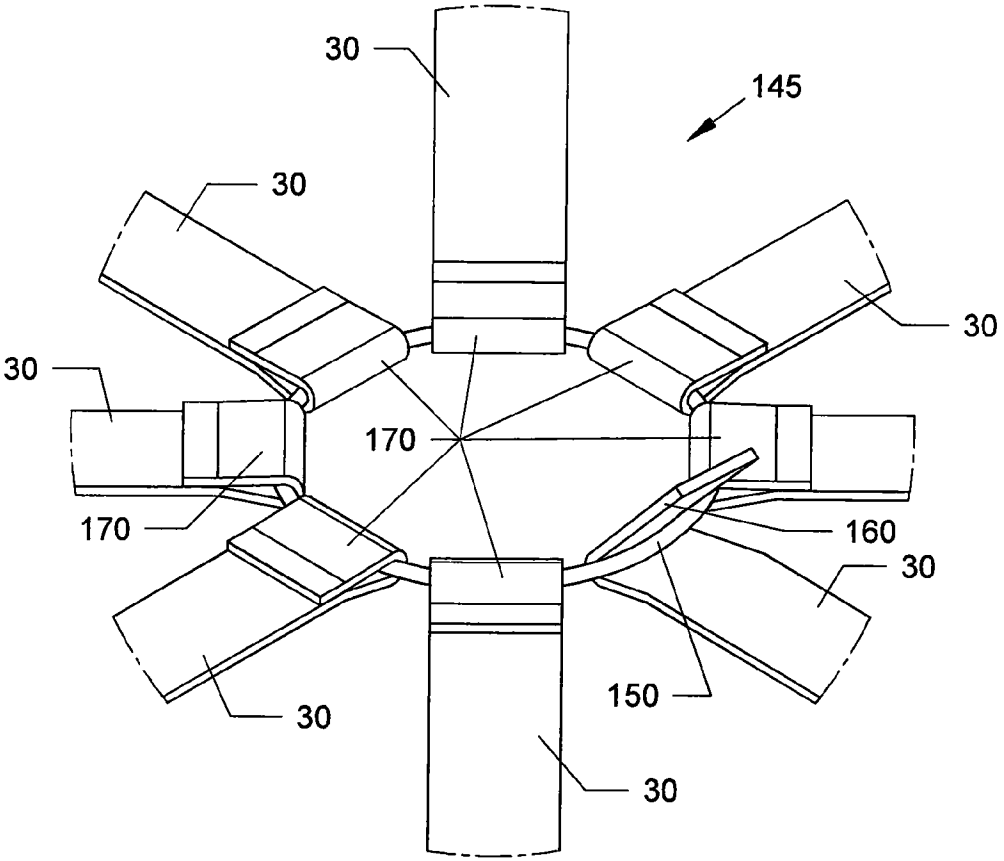
FIG. 9 is an enlarged view of the central ring union point of FIG. 8.

FIG. 8 is a perspective view of sheet securing device 140 with eight bands/straps 30 with eight clip 20 sheet securing device with an alternate ring union point 145. FIG. 9 is an enlarged view of the central ring union point 145 of FIG. 8, which shows folded ends 170 of the straps 30 wrapped 160 about a central ring 150. The central ring 150 can be a metal ring, plastic ring, combinations thereof, and the like. The use of the central ring 150 allows for the ends 160, 170 of the bands/straps 30 to be able to slide and move relative to one another when the device 140 is installed under a mattress 110, and while the device 145 is being attached by clips 20/25 to outer edges of the bottom sheet 120.

The clip ends of the elastic bands can be alligator clips, suspender clips, and the like. Other types of clips, can be used such as snap clips, and the like. Additionally, the clips can include closeable clamps, and the like. The clips can be formed from metal, plastic, combinations thereof, and the like.

Although a preferred embodiment uses the cross pattern of elastic bands to have the clip ends attached only to edge portions of the bottom sheet, the invention can be applied in other manners.

For example, some clip ends such as a top middle clip end, top right and left corner clip ends can clip about relative locations such as a top middle portion, and top right and top left corner portions of the bottom sheet. Bottom middle clip end, bottom left and right corner clip ends can clip about relative locations such as a bottom middle portion and bottom right and left corner portions of both the bottom sheet and top sheet on the mattress.

Another example, can have the bottom middle clip end, bottom left and right corner clip ends can clip about relative locations such as a bottom middle portion and bottom right and left corner portions of both the bottom sheet and top sheet and blanket on the mattress.

Another example, can have the bottom middle clip end, bottom left and right corner clip ends can clip about relative locations such as a bottom middle portion and bottom right and left corner portions of both the bottom sheet and blanket on the mattress.

While the embodiments show the use of eight and twelve bands/straps, the invention can be used with four bands/straps that also have a central cross pattern, where the four ends attach only to corner area edges of the bottom sheet on the mattress. Also, other numbers, such as five, six, seven, nine, ten, eleven, and thirteen or more straps can be used.

Although the preferred embodiments describe the invention being useable from single bed mattresses through king size bed mattresses, other sizes mattresses, can be used such as on crib mattresses and small child bed mattresses, and the like.

The novel invention can be used with bottom sheets that have fitted corners, that include elastic forming pockets, or other types of pockets, and the like. The invention can also be used with bottom sheets that are not fitted, and are only tucked underneath a mattress.

Although the drawings show the invention used with bottom sheets, the novel invention can be used with both a bottom sheet and a top sheet, a bottom sheet and a blanket/cover, a bottom sheet with both a top sheet and a blanket/cover, or a top sheet with a blanket/cover on a bed.

The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A system for keeping bed sheets from being disengaged from a mattress, comprising:

a plurality of elastic bands arranged in a cross pattern, each of the elastic bands having a folded end and a free end;

a central ring, wherein each of the folded ends of the elastic bands is separately wrapped about a separate portion of the central ring so that each of the folded ends of each elastic band slides along the separate portion of the central ring; and clips attached to each free end of the elastic bands, wherein the cross pattern of the elastic bands is adapted to be positioned underneath a mattress having a bottom sheet thereon, with the clips being clamped to outer edge portions of the bottom sheet in order to keep the bottom sheet on the mattress.

2. The system of claim 1, wherein the cross pattern of elastic bands includes:

four outer ends of the bands;

four clips attached to each of the four outer ends of the bands, the four clips being adapted to clamp about each of four corner portions of the bottom sheet.

3. The system of claim 1, wherein the cross pattern of elastic bands includes:

eight outer ends of the bands;

eight clips attached to each of the eight outer ends of the bands, the eight clips being adapted to clamp about each of four corner portions of the bottom sheet, as well as to edge portions of the bottom sheet between each of the four corners of the bottom sheet.

4. The system of claim 1, wherein the cross pattern of elastic bands includes:

twelve outer ends of the bands;

twelve clips attached to each of the outer ends of the bands, the twelve clips being adapted to clamp about edge portions of the bottom sheet.

5. The system of claim 1, wherein the clips include: alligator clips.

6. The system of claim 1, wherein the clips include: suspender clips.

7. A device to prevent bedding from becoming loose from a mattress, comprising:

a plurality of elastic bands arranged in a cross configuration, each of the bands having outer ends and inner folded ends;

a central ring, wherein each of the folded ends of the elastic bands is separately wrapped about a separate portion of the central ring so that each of the folded ends of each elastic band slides along the separate portion of the central ring; and clips attached to each of the outer ends of the elastic bands, wherein the cross configuration of the elastic bands is adapted to be positioned underneath a mattress having a bottom sheet thereon, with the clips being clamped to outer edge portions of the bottom sheet in order to hold the bottom sheet on the mattress.

8. The device of claim 7, wherein the clips include: suspender clips.

9. The device of claim 7, wherein the clips include: alligator clips.

10. The system of claim 7, wherein the cross pattern of elastic bands includes:

twelve outer ends of the bands;

twelve clips attached to each of the twelve outer ends of the bands, the twelve clips being adapted to clamp about edge portions of the bottom sheet.

11. The device of claim 7, wherein the cross configuration of elastic bands includes:

eight outer ends of the bands;

eight clips attached to each of the eight outer ends of the bands, the eight clips being adapted to clamp about each of four corner portions of the bottom sheet, as well as to edge portions of the bottom sheet between each of the four corners of the bottom sheet.

12. The device of claim 7, wherein the cross configuration of elastic bands includes:

four outer ends of the bands;

four clips attached to each of the four outer ends of the bands, the four clips being adapted to clamp about each of four corner portions of the bottom sheet.

* * * * *